US005837922A

United States Patent [19]

Maher et al.

[11] Patent Number: 5,837,922

[45] Date of Patent: Nov. 17, 1998

[54] AMMUNITION STORAGE AND RETRIEVAL SYSTEM

[75] Inventors: David Lord Maher, Burlington; Derek Albert Rodriguez, Milton; Stephen Austin Jarvis, Colchester, all of Vt.

[73] Assignee: General Dynamics Armament Systems, Inc., Falls Church, Va.

[21] Appl. No.: 768,063

[22] Filed: Dec. 16, 1996

[51] Int. Cl.[6] ..... F41A 9/39

[52] U.S. Cl. ..... 89/46; 89/47

[58] Field of Search ..... 89/45, 46, 47

[56] References Cited

U.S. PATENT DOCUMENTS

| | | | |
|---|---|---|---|
| 4,481,862 | 11/1984 | Wiethoff et al. | 89/46 |
| 4,648,305 | 3/1987 | Elspass | 89/45 |
| 4,947,728 | 8/1990 | Muhlhausen et al. | 89/46 |
| 5,022,308 | 6/1991 | Heldmann et al. | 89/45 |
| 5,054,367 | 10/1991 | Heldman et al. | 89/46 |
| 5,472,367 | 12/1995 | Slocum et al. | 451/5 |
| 5,526,730 | 6/1996 | Zangrando | 89/46 |
| 5,674,109 | 10/1997 | Kanzawa et al. | 451/286 |

FOREIGN PATENT DOCUMENTS

| | | | |
|---|---|---|---|
| 36 42 920 A1 | 6/1988 | Germany | 89/46 |
| 1523432 | 8/1978 | United Kingdom | 89/46 |

*Primary Examiner*—Stephen M. Johnson
*Attorney, Agent, or Firm*—Finnegan, Henderson, Farabow, Garrett & Dunner

[57] ABSTRACT

An ammunition storage and retrieval system comprises a passive magazine having left and right backs of cells arranged in rows, with each cell accommodating a projectile in vertical, base-down orientation; the cells and cell rows being defined by adjacent pairs of elongated superstructures. A projectile loading head is movably mounted by a traveling beam, in turn, movably mounted by elevated rails, such that the loading head may be translated through a center aisle to address a selected row in either bank and then through the selected row to a selected cell for downloading of a projectile therein. A projectile receiver, dependent from the loading head, includes projectile gripping arms and a projectile lifting foot, which are articulated in coordination with operation of projectile locking members mounted by the superstructures to effect downloading.

35 Claims, 11 Drawing Sheets

AMMUNITION STORAGE AND RETRIEVAL SYSTEM

This invention was made with Government support under contract No. DAAE30-95-C-0009 awarded by the United States Army. The Government has certain rights in the invention.

BACKGROUND OF THE INVENTION

1. Field of the Invention

The present invention relates to ammunition handling facilities, and particularly to ammunition storage and retrieval facilities suitable for serving automated howitzers installed on combat vehicles, such as tanks.

2. Background of the Invention

Ammunition magazines for storing large caliber rounds of ammunition, such as those fired by howitzers, are generally of two types, active and passive. Active magazines include an internal ammunition conveyor that must be driven to upload ammunition rounds into the magazine for storage and then driven again to successively download the ammunition rounds for firing. A passive magazine, on the other hand, is designed to provide a plurality of cells where the ammunition rounds (projectiles) are stored in fixed positions. A robotic transfer apparatus is then required to enter the magazine and traverse to each cell in succession to upload and download projectiles.

A design consideration common to both magazine types is safely securing the projectiles in their magazine storage positions. When the magazines are installed in combat vehicles, travel over rough terrain subjects the projectiles to shock loads that can dislodge them from their magazine storage positions. Furthermore, the magazine must be designed to relax the restraints on the projectiles, such that they can be readily uploaded and downloaded in rapid fashion.

SUMMARY OF THE INVENTION

It is accordingly an objective of the present invention to provide improvements in passive ammunition magazines and robotic transfer apparatuses of an ammunition storage and retrieval system.

An additional objective of the present invention is to provide an improved ammunition storage and retrieval system that is economical to manufacture, readily adapted to combat vehicles, and efficient and reliable in operation over a long service life.

Additional features and advantages of the invention will be set forth in the description that follows, and, in part, will be apparent from the description, or may be learned from practice of the invention. The objectives and other advantages of the invention will be realized and attained by the system particularly pointed out in the written description and claims hereof, as well as in the appended drawings.

To achieve these and other objectives, and in accordance with the purpose of the present invention as embodied and broadly described, an ammunition storage and retrieval system is provided, which comprises a passive magazine including a plurality of rows of cells, each row including plural cells, and each cell for storing a projectile in base-down vertical orientation. A traverse mechanism includes a pair of elongated rails mounted in parallel, spaced relation above the magazine and an elongated beam mounted at opposed ends by the rails for movement in first opposite directions along the rails. A projectile loading head is then mounted by the beam for movement in second opposite directions along the beam. The loading head, in turn, rotatably mounts a projectile receiver in suspended relation, the projectile receiver including projectile gripping arms.

The system further comprises plural motors coupled to introduce input drive through the rails and the beam, such as to propel the beam in the first opposite directions to position the loading head into alignment with a selected one of the cell rows and to propel the loading head in the second opposite directions along the selected row and into and out of a projectile downloading position relative to a selected one of the cells in the selected row. Motor input drives are also coupled into the loading head, such as to rotate the projectile receiver about a vertical axis and to articulate the gripper arms between projectile gripping and releasing positions pursuant to uploading/downloading a projectile.

It is to be understood that the foregoing general description and the following detailed description are exemplary and explanatory and are intended to provide further explanation of the invention defined in the appended claims.

BRIEF DESCRIPTION OF THE DRAWINGS

The accompanying drawings, which are incorporated in and constitute a part of this specification, illustrate embodiments of the invention and, together with the following detailed description, serve to explain the objectives, advantages, and principles of the invention.

In the drawings.

Like reference numerals refer to corresponding parts throughout the several views of the drawings.

DETAILED DESCRIPTION OF THE INVENTION

Figure 1:
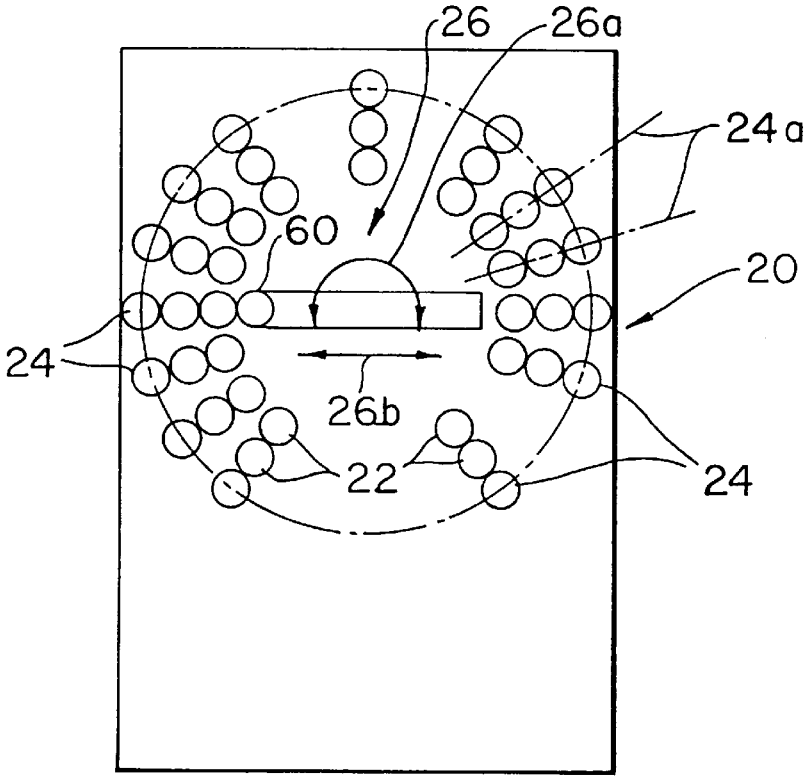
FIGS. 1 and 2 are schematic illustrations of alternative layouts of passive ammunition magazines to which the present invention may be adapted.

In the layout of a passive ammunition magazine, generally indicated at 20 in the schematic illustration of FIG. 1, a plurality of ammunition rounds or projectiles 22, such as howitzer rounds, stored in vertical, base down orientations, are arranged in a circular array including a plurality of angularly spaced, radial rows 24 of projectiles. The central portion of magazine 20 is open to provide space for a robotic transfer mechanism, generally indicated at 26, operable to rotate, as indicated by arrow 26*a*, into positions aligned with centerlines 24*a* of the rows 24 and then to move linearly, as indicated by arrow 26*b*, in and out along the row axes to pick up projectiles 22 for transfer to a cannon of a military combat vehicle (not shown).

Figure 2:
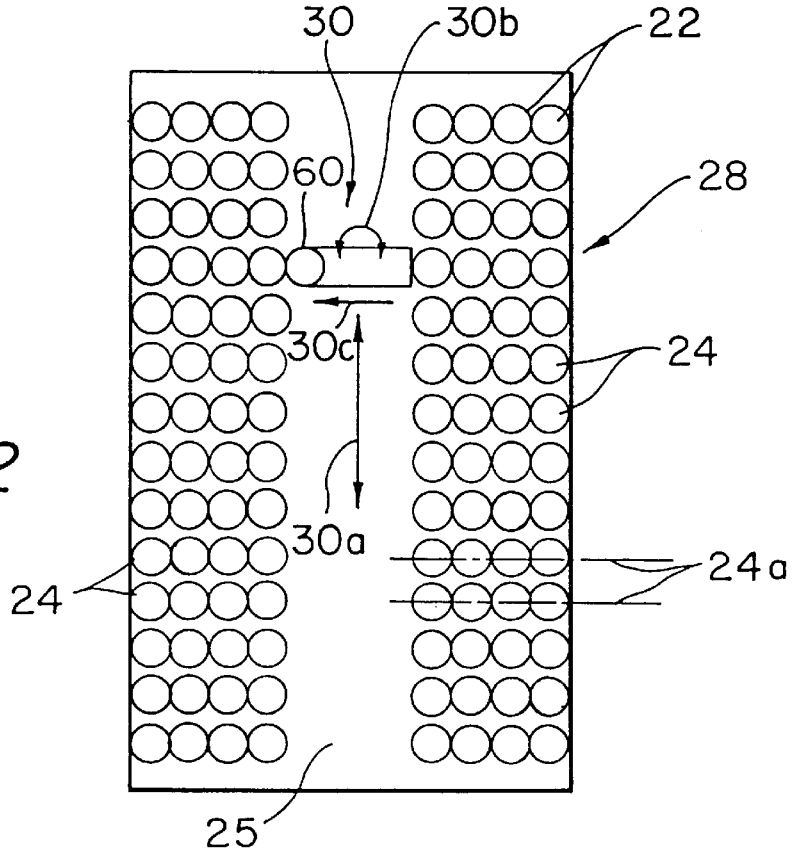

In an alternative layout schematically illustrated in FIG. 2, a passive magazine, generally indicated at 28, stores the projectiles 22 in left and right banks of rows 24 separated by a center aisle 25. A robotic transfer mechanism 30 moves through aisle 25, as indicated by arrow 30*a*, into alignment with the centerlines 24*a* of rows 24, rotates, as indicated by arrow 30*b*, to address either the right or left banks of rows, and moves in and out along the row centerlines, as indicted by arrow 30*c*, to pick up projectiles 22 for transfer to a tank cannon (not shown).

Figure 3:
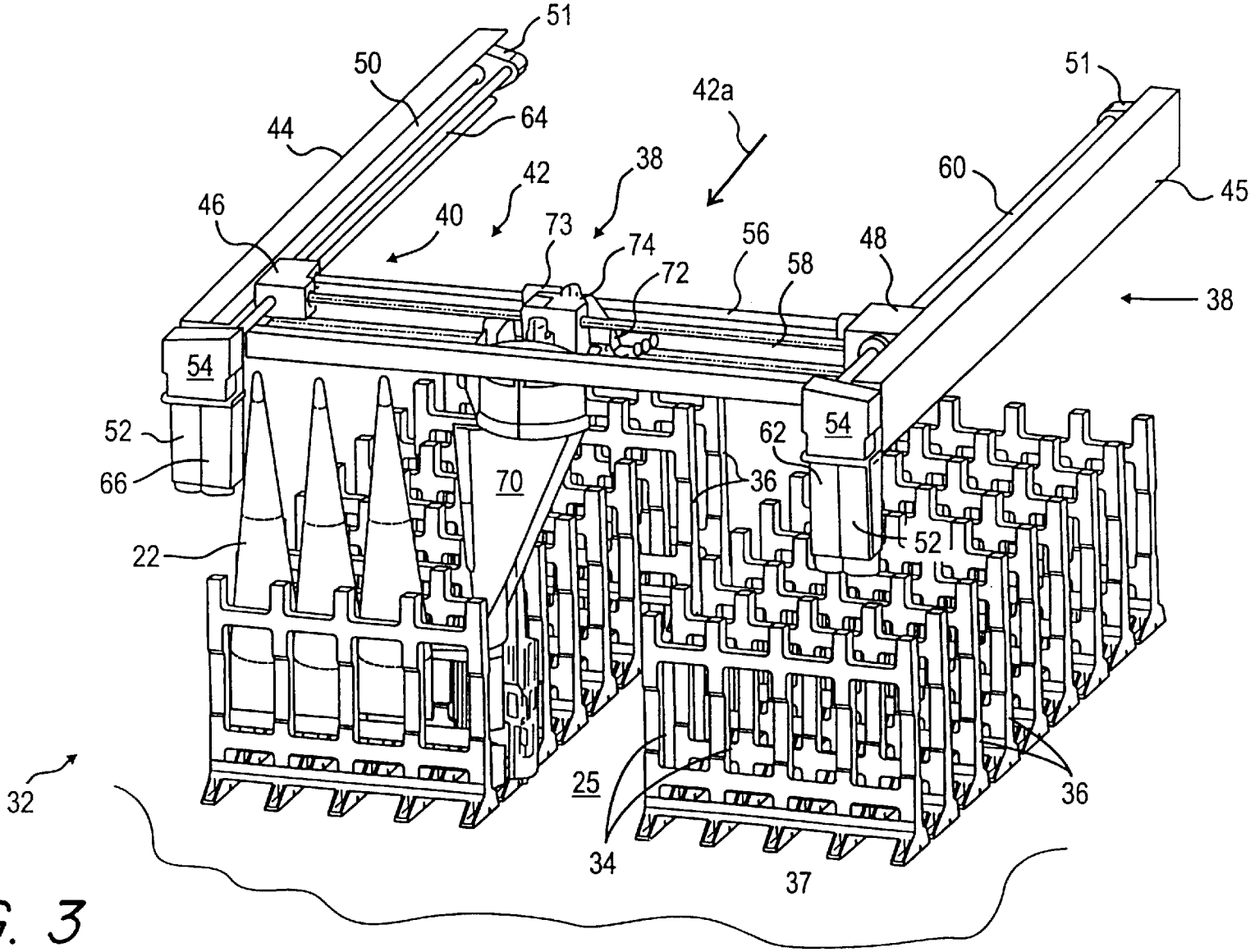
FIG. 3 is a perspective view of an ammunition storage and retrieval system in accordance with one embodiment of the invention.

In the passive magazine embodiment of the invention seen in FIG. 3, generally indicated at 32, the projectiles 22 are stored in left and right banks of rows separated by a center aisle 25 in the manner illustrated in FIG. 2. Each row includes a plurality of cells 34 defined by each adjacent pair of linear superstructures, generally indicated at 36, that are affixed, e.g., bolted, to a platform 37 fixed to a combat vehicle. Magazine 32 is served by a robotic transfer apparatus, generally indicated at 38.

Figure 4:
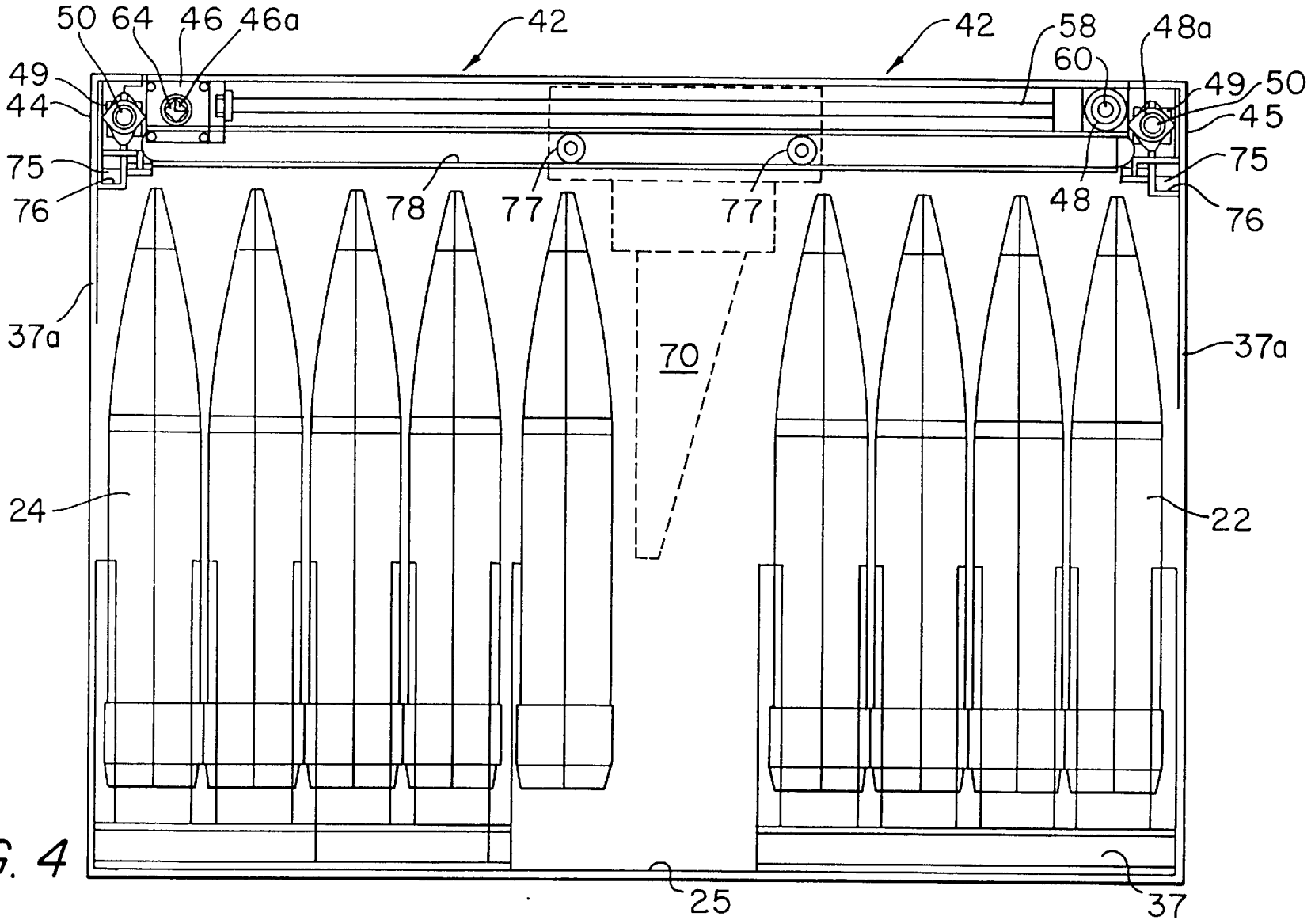
FIG. 4 is a front elevational view of the system of FIG. 3.

This transfer apparatus includes an X-Y traverse mechanism, generally indicated at 40, comprising, with joint reference to FIGS. 3 and 4, a transverse, traveling beam, generally indicated at 42, and a pair of longitudinal rails 44, 45 supported in opposed parallel relation by posts 37*a* in elevated positions relative to platform 37. The ends of traveling beam 42 are equipped with gearboxes 46, 48, operating to take off separate mechanical input drives from the rails. Thus, each gearbox mounts a ballnut 49 that threadedly engages elongated ballscrew 50 mounted by each rail. The rearward ends of the ballscrews are journalled in bearing blocks 51. Further, the longitudinal ballscrews 50 are driven in unison by separate, synchronized electric motors 52 through respective right angle drive units, such as beveled gearsets (not shown) included in gearboxes 54 mounted at the forward ends of rails 44, 45 to produce bidirectional longitudinal movement of beam 42, as indicated by arrow 42*a* in FIG.3.

The traveling beam gearboxes 46, 48 also include beveled gearsets for transferring separate input drives to an elongated ballscrew 56 and an elongated spline shaft 58 extending transversely in parallel relation coextensively with the traveling beam. In particular, gearbox 46 includes a right angle drive, beveled gearset 46*a* to pick off input drive for ballscrew 56 from an elongated spline shaft 64 mounted by rail 44 and driven by an electric motor 66 via a separate right angle drive bevel gear set in gearbox 54 carried at the forward end of this rail. Gearbox 48, on the other hand, includes a right angle drive beveled gearset 48*a* to pick off input drive for spline shaft 58 from a spline shaft 60 mounted by rail 45 and driven by an electric motor 62 via a separate right angle drive bevel gearset in gearbox 54 carried at the forward end of this rail.

It will be understood that the driving bevel gears of the sets 46*a*, 48*a* have splined bores that respectively engage the rail spline shafts 64, 60 and thus move longitudinally along the rails while maintained in meshing engagement with the driven bevel gears by the bearing mountings provided by gearboxes 46, 48. The driven bevel gears of the sets are respectively fixed on one ends of beam ballscrew 56 and spline shaft 58, with their other ends journalled in gearboxes 48 and 46, respectively.

Ballscrew 56 and spline shaft 58 of traveling beam 42 provide separate input drives for operating a projectile loading head, generally indicated at 70. In particular, a ballnut 73, mounted to a carriage 72 of loading head 70, travels on ballscrew 56 to produce bidirectional transverse motion of the loading head through the rows of the left and right magazine banks to selected cells in accordance with programmed energization of motor 66. Programmed energization of motors 52 propel the traveling beam 42 along the center aisle 25 to position the loading head in alignment with a selected row in either the left or right bank. As will be described in detail below, a gearbox 74, mounted to carriage 72, includes a right angle drive bevel gearset, not shown, for picking off input power from spline shaft 58 to operate loading head 70 in accordance with controlled energizations of motor 62. The loading head operations include rotating the loading head about a vertical axis to address a row 24 in either of the left or right cell banks and articulating elements of the loading head to effect uploading and downloading of projectiles 22 to and from the cells.

Figure 10:
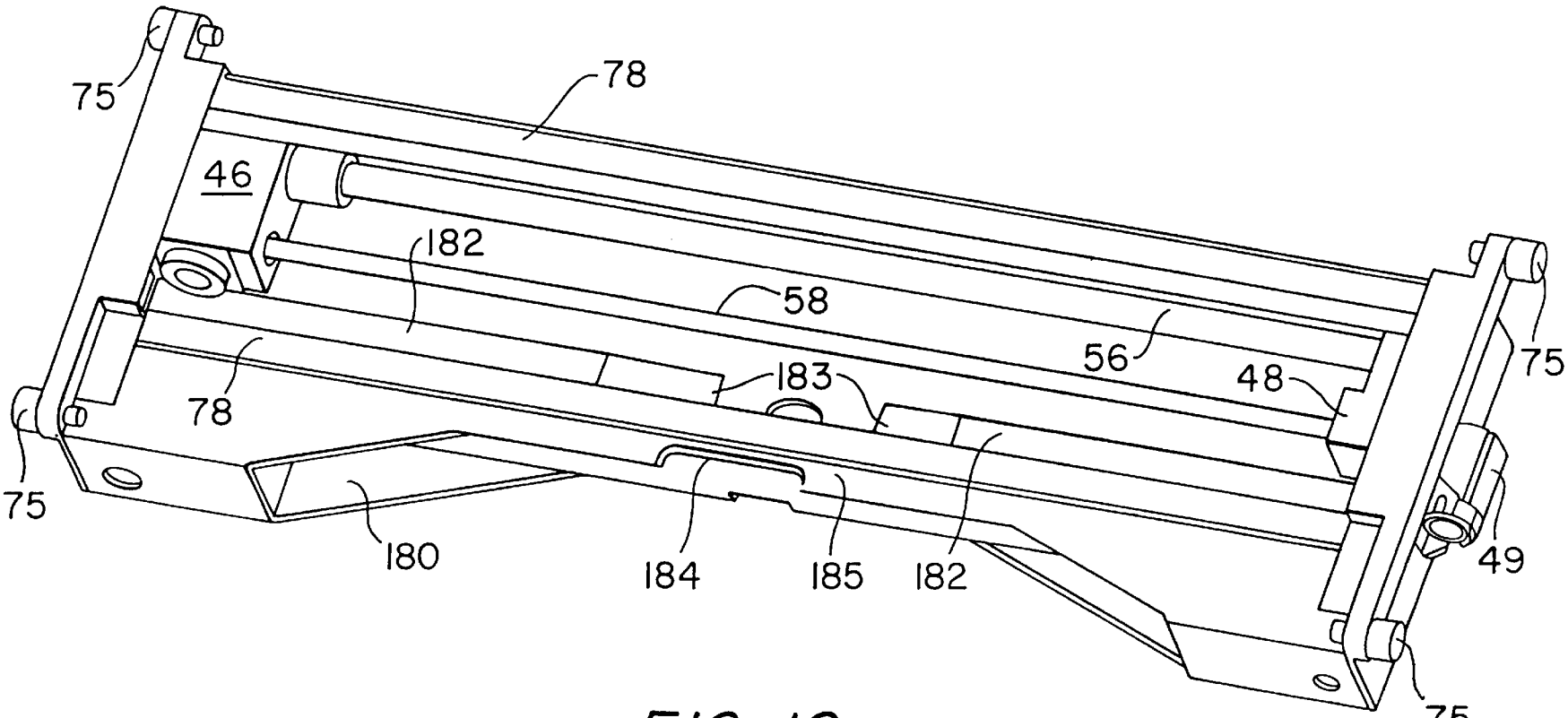
FIG. 10 is an underside perspective view of a traveling beam included in the system of FIG. 3.

As seen in FIGS. 4 and 10, rollers 75, mounted at the ends of traveling beam 42, run in tracks 76 included in rails 44, 45 to support and guide the traveling beam during longitudinal motion. Similarly, carriage 72 of the loading head 70 includes longitudinally opposed pairs of rollers 77, best seen in FIG. 8, which run in opposed tracks 78 (FIGS. 4 and 10) included in the traveling beam 42.

Figure 5:
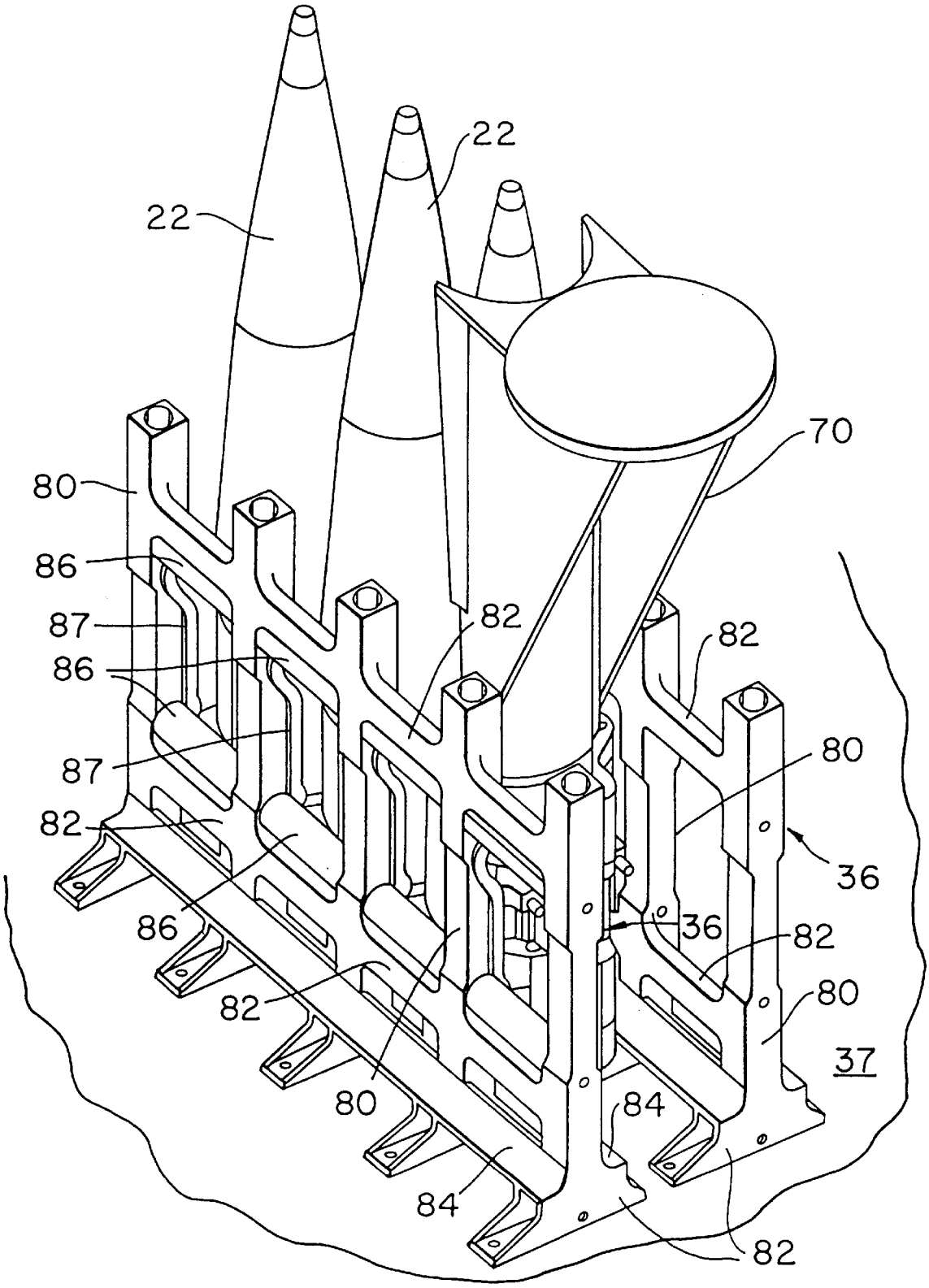
FIGS. 5 and 6 are enlarged, fragmentary perspective views, illustrating structural details of the magazine cells included in the system of FIG. 3.
Figure 6:
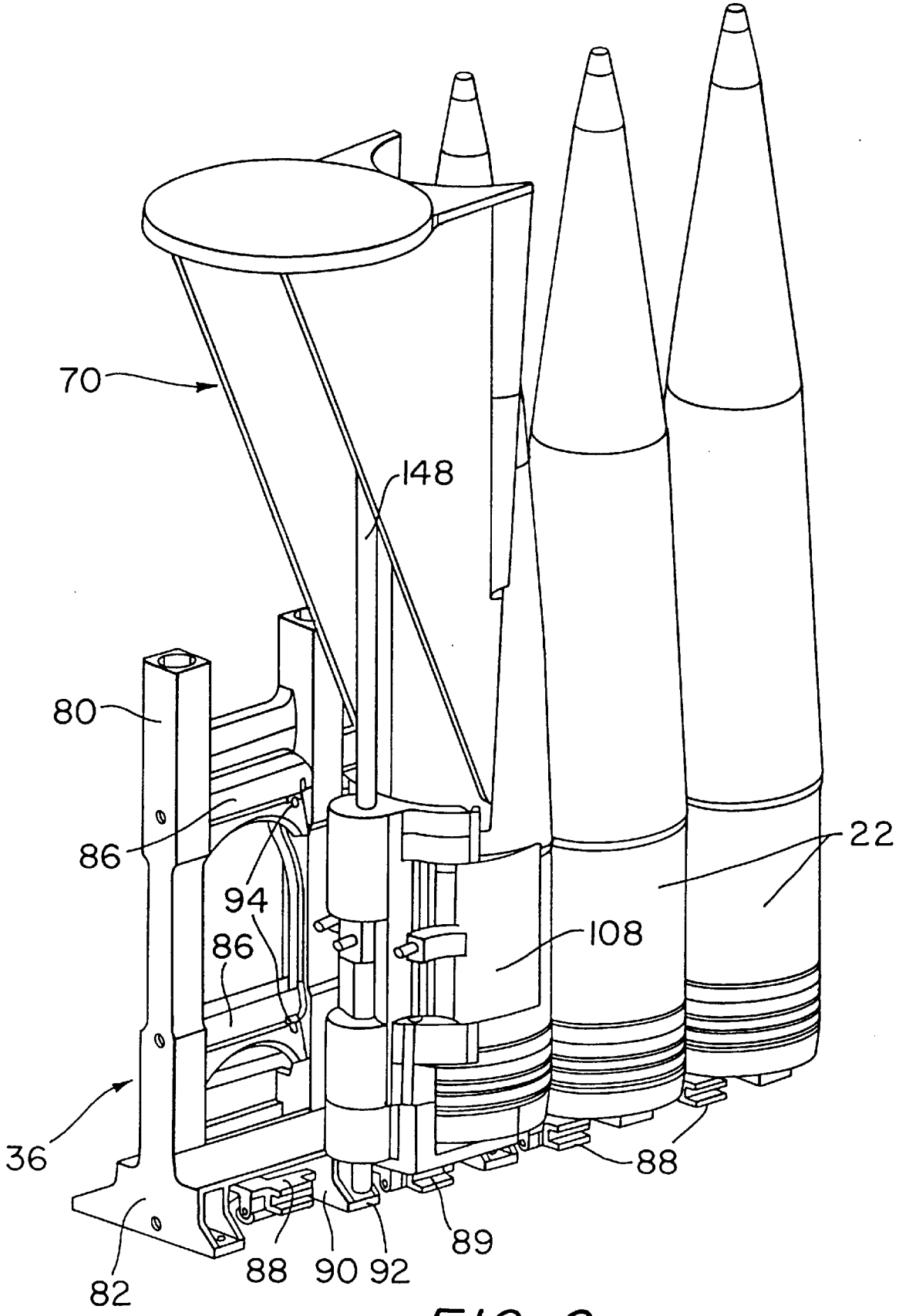
Figure 7:
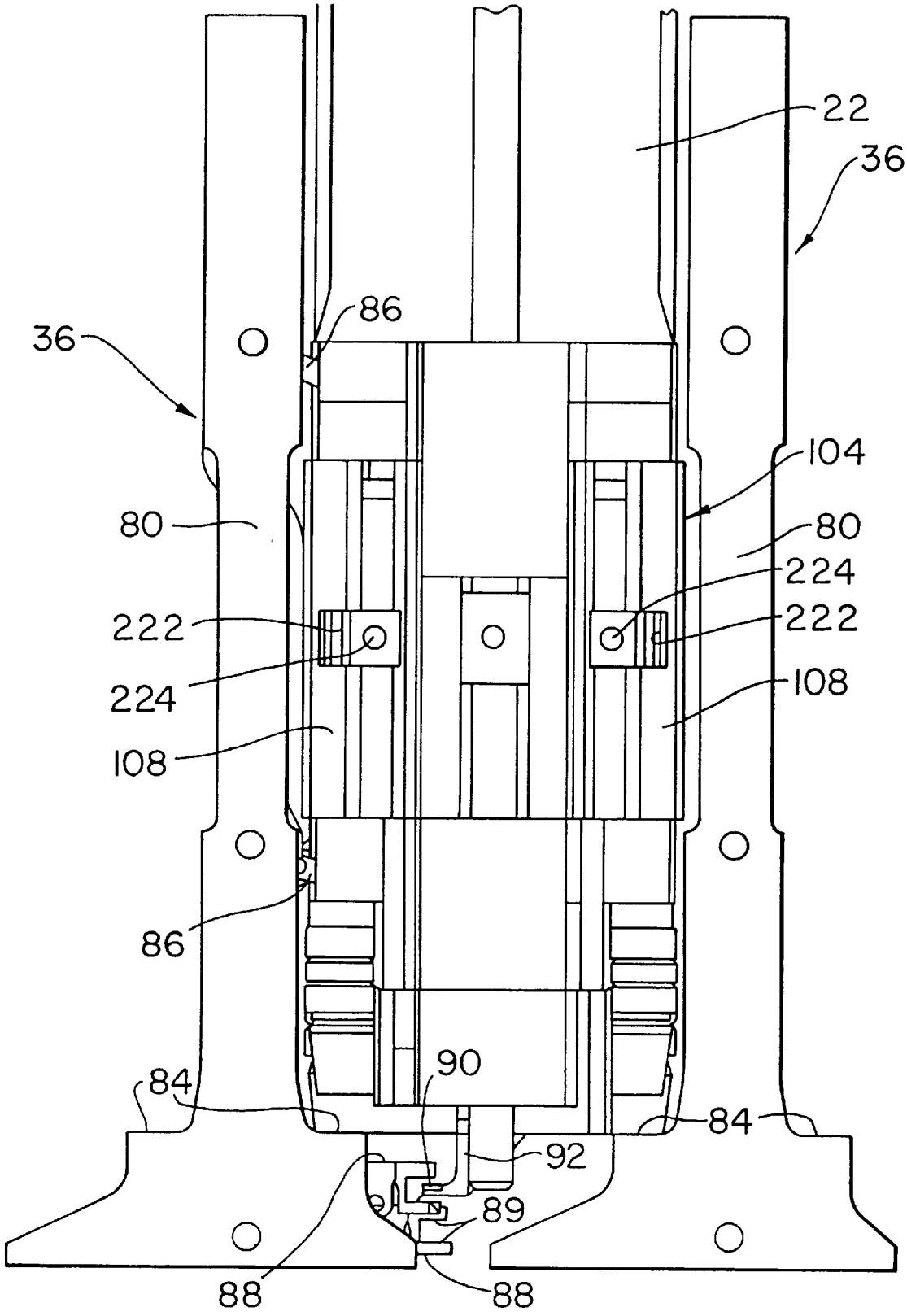
FIG. 7 is an enlarged elevational view of a lower portion of a magazine cell included in the system of FIG. 3.

As seen in FIGS. 5–7, superstructures 36 preferably are of a one-piece modular construction including a plurality of posts 80 upstanding from feet 82 equipped for bolted attachment to platform 37. Posts 80 are integrally interconnected by upper and intermediate cross members 82 and lowermost front and back channel members 84; the channel member serving as projectile base supports for adjacent rows of cells 34, as best seen in FIG. 7. Upper and lower sets of locking members 86, preferably of the cradle-shaped, wedge-lock operating type described in co-pending application Ser. No. 08/609,708, filed Mar. 1, 1996, are pivotally mounted between adjacent pairs of post 80, as best seen in FIG. 6. The disclosure of this commonly assigned application is incorporated herein by reference. The upper and lower locking members 86 of a cell, which are interconnected by a link 87, swing upwardly in unison into locking positions from the front side of one superstructure 36, and, in conjunction with the cross members 82 at the back side of the adjacent row-defining superstructure 36, produce wedging actions to lock projectiles 22 in their cells 34, as described in the cited co-pending application.

As best seen in FIGS. 6 and 7, pivotally mounted beneath adjacent pairs of posts 80 and projecting forwardly beneath respective cells 34, are operator tongues 88 that include slots 89 for receiving a toe 90 carried by a foot 92 of loading head 70 when moved into a centered position of a cell 34. In the manner described in the cited co-pending application, foot 92 articulates operator tongue 88 between a raised, open-cell position and a lowered, closed-cell position. Operator tongues 88 are connected by a suitable linkage to associated pairs of locking members 86 of a cell 34, such as to be pivoted to their locking positions as the tongues are lowered to their closed-cell positions and pivoted to their release positions as the tongues are raised to their open-cell positions. The linkage may include, for example, a four-bar linkage connecting tongue 88 to the locking member link 87 of a cell, such as to provide essentially straight line vertical movement of the tongue between open and closed-cell positions. Springs 94 (FIG. 6) serve to detain the locking members 86 in their raised, wedge-lock positions securely holding the projectiles in their cells. To detent the locking members in their lowered, release positions, compression springs may be incorporated in the post 80 to act against cams fixed to the locking member pivot shafts, as described in the cited co-pending application.

Figure 8:
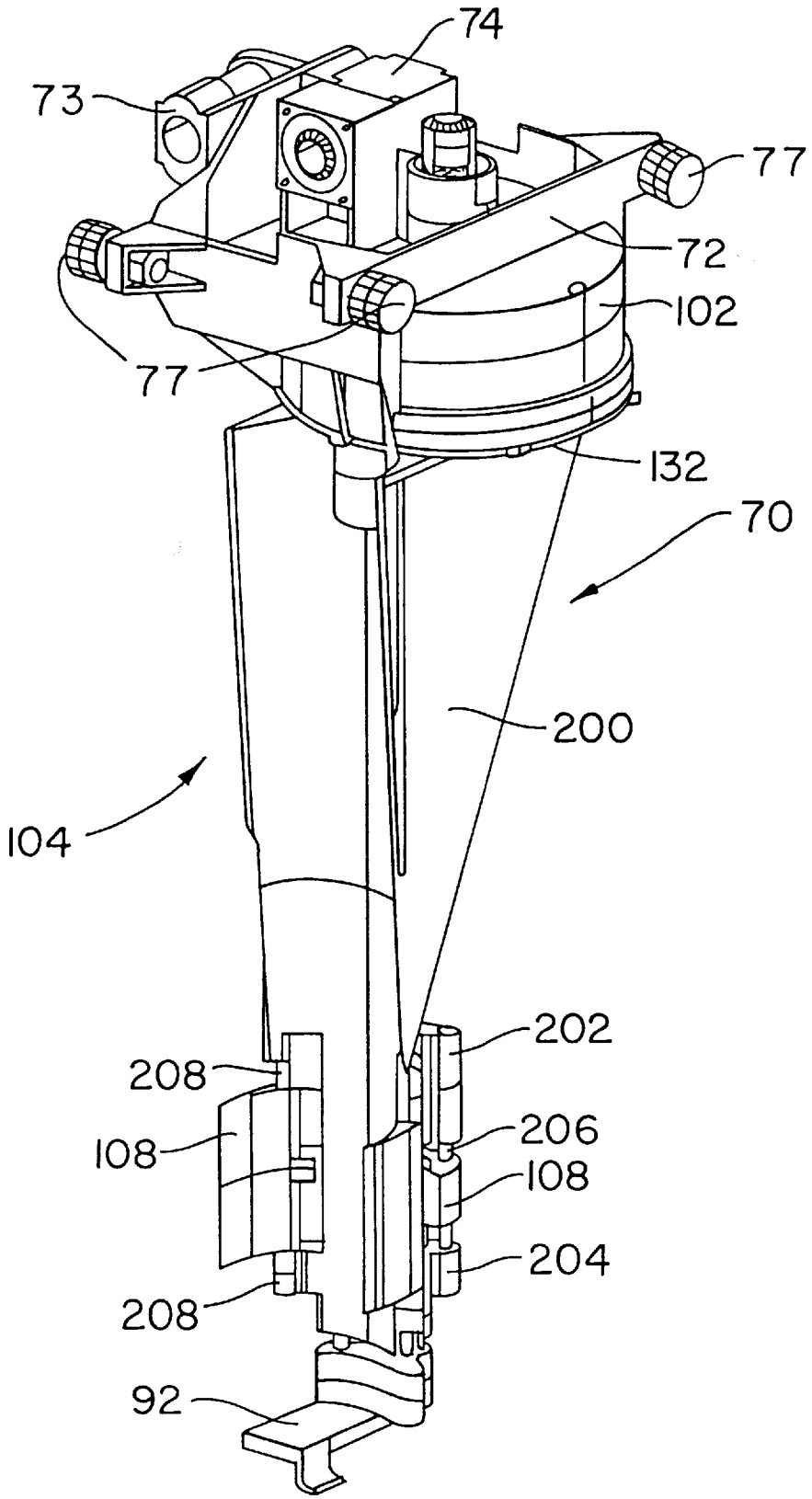
FIG. 8 is a perspective view of an ammunition loading head included in the system of FIG. 3.

Loading head 70 further comprises, as seen in FIG. 8, a differential gear mechanism, mounted by carriage 72 and generally indicated at 102, from which is depended a projectile receiver, generally indicated at 104. Gearbox 74, also mounted to the carriage, picks off power from transverse spline shaft 58 to rotate, via differential gear mechanism 102, projectile receiver 104, while the loading head is in the center aisle 25 (FIG. 3), and to vertically move foot 92 (FIG. 7)in coordination with opening and closing motions of gripper arms 108, when the loading head 70 is center-positioned at a magazine cell 34.

Figure 9:
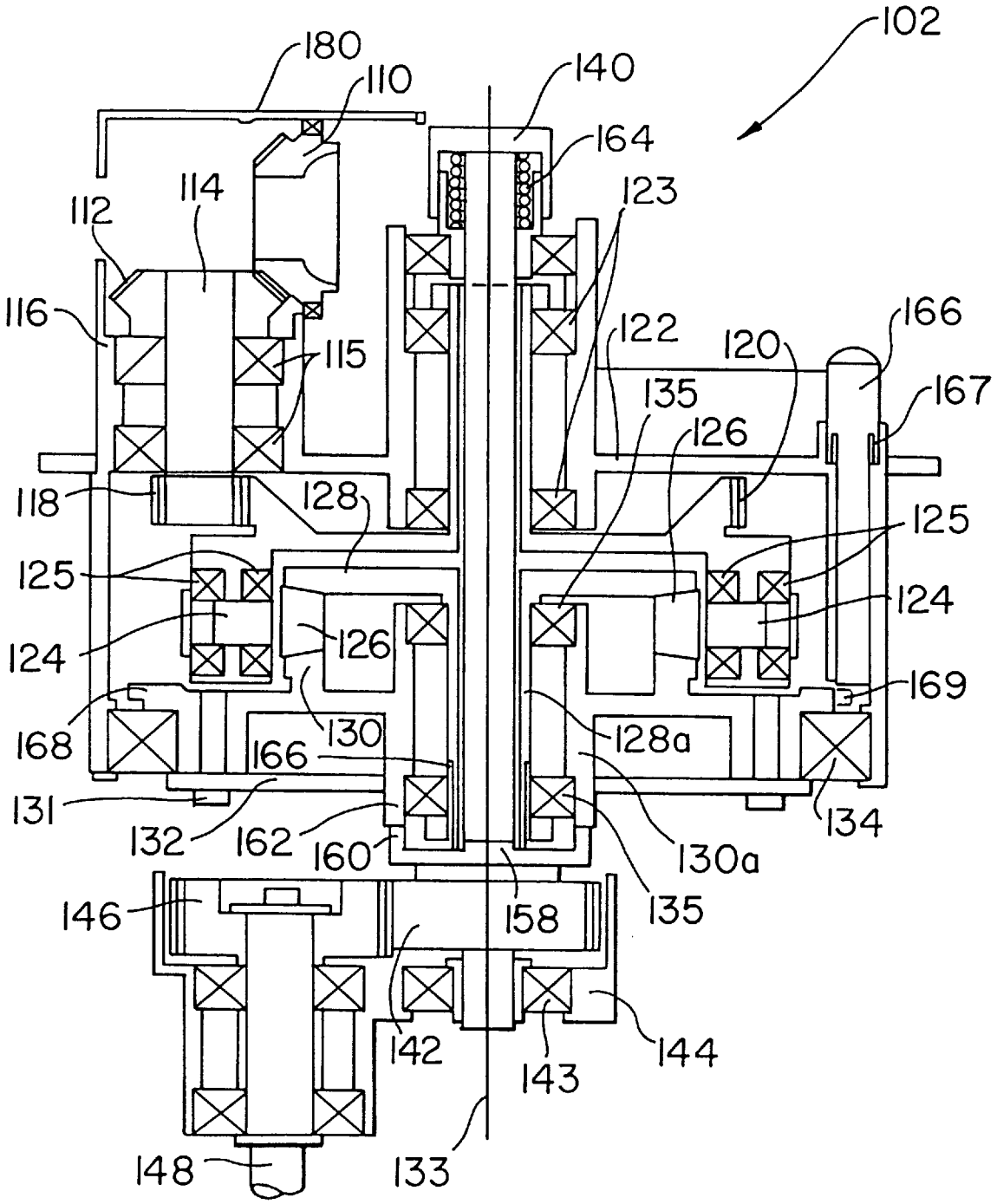
FIG. 9 is a sectional view of a shiftable gear mechanism included in the loading head of FIG. 8.

To achieve these functions, differential gear mechanism 102 is preferably constructed in the manner illustrated in FIG. 9. The bevel gear (illustrated in partial view at 110) in gearbox 74, that slides on transverse spline shaft 58 (FIG. 3), meshes with a bevel gear 112 to transfer input drive to a vertical stub shaft 114 journalled by bearings 115 mounted by gear mechanism housing 116. A pinion gear 118, keyed to the lower end of stub shaft 114, drives a ring gear 120 integrally formed with a cage 122 that is journalled to housing 116 by bearings 123. Cage 122 carries diametrically opposed stub shafts 124, journalled by bearings 125. The inner ends of these stub shafts carry bevel pinion gears 126 in meshing engagement with an upper bevel ring gear 128 and a lower bevel ring gear 130. The lower bevel ring gear is affixed by bolts 131 to a plate 132 from which the projectile receiver 104 is hung, as seen in FIG. 8. Lower bevel ring gear 130 is journalled for rotation about vertical axis 133 by bearings 134 captured by housing 116. Upper and lower bevel ring gears are formed with coaxial sleeves 128*a* and 130*a*, respectively, with bearings 135 captured therebetween to mount the upper bevel ring gear 128 for rotation relative to the lower bevel ring gear 130.

A vertically elongated plunger 140 is mounted coaxially with axis 133 of differential gear mechanism 102 and carries at its lower end a spur gear 142 mounted for rotation and limited vertical movement by bearings 143 captured by a frame structure 144 of projectile receiver 104. Spur gear 142 meshes with a spur gear 146 keyed to the upper end of a lead screw 148 which, as will be seen, propels coordinated vertical motion of foot 92 and opening and closing movements of gripper arms 108 seen in FIG. 8.

Also shown in FIG. 9, just above the juncture of plunger 140 and spur gear 142, a ring 158 is fixed to the plunger. This ring is provided with a plurality of angularly spaced, upstanding dogs 160 which engage or disengage a plurality of angularly spaced dogs 162 formed in the lower annular edge the central sleeve 130*a* of lower bevel ring gear 130. Clutching engagement and disengagement of dogs 160, 162 are determined by the vertical position of plunger 140. A compression spring 164 normally biases plunger 140 to an elevated vertical position, thus raising dogs 160 into clutched engagement with dogs 162. It is also noted that plunger 140 and central sleeve 128*a* of upper bevel ring gear are rotationally coupled together by vertical splines, indicated at 166, such that spur gear 142 is driven directly off of the upper bevel ring gear.

When spring 164 is free to bias plunger to its elevated vertical position, such that the dog clutch (dogs 160, 162) is engaged, it is seen that the upper and lower bevel ring gears are clutched together. Consequently, bevel pinion gears 126 carried by the ring gear cage 122 can not rotate. The input drive picked from the travelling beam spline shaft 58 via bevel gear 110 then rotates the ring gear cage and the upper and lower bevel ring gears in unison. Since lower bevel ring gear 130 is fixed to the projectile receiver support plate 132, the projectile receiver 104 is simply rotated about the vertical axis 133. Since spur gear 146 revolves about this vertical axis as spur gear 142 is driven about this same axis, there is no relative rotation of these spur gears to produce rotation of lead screw 148. Consequently foot 92 and gripper arms 108 of projectile receiver 104 are not operated.

When plunger 140 is depressed, however, it is seen that the dog clutch (dogs 160 and 162) is disengaged to decouple upper 128 and lower 13 bevel ring gears. As will be described, concurrently with automatic depression of plunger 140, a rotation lock plunger 166 is also depressed against the upward bias of a compression spring 167 to engage one of four 90° angularly spaced rotation lock notches formed in an angular edge 168 of lower bevel ring gear 130, one seen at 169. In this case, since the lower bevel ring gear is locked against rotation, so too is the projectile receiver. Thus, when the ring gear cage 122 is rotated by the input drive taken from the transverse spline shaft 58, the revolving bevel pinion gears 126 react against the stationary lower bevel ring gear 130 to drive upper bevel ring gear 128. This rotational drive is transmitted through splines 166 and spur gears 142 and 146 to turn lead screw 148, resulting in operations of foot 92 and gripper arms 108 of projectile receiver 104.

The underside view of the travelling beam 42, seen in FIG. 10, illustrates a coextensive cover 180, removed from FIG. 3, with provisions for appropriately vertically positioning plungers 140 and 166. It will be appreciated that rotation of projectile receiver 104 is appropriate only when loading head 70 is positioned in the center aisle 25 by motor 66 seen FIG. 3. While the loading head is in a center aisle position, the projectile receiver foot and gripper arms should not be actuated. Conversely, the projectile receiver should not be rotated while the loading head is in any of the magazine rows, but it is then that the foot and gripper arms of the loading head need to be actuated to upload/download the magazine cells. Thus, projectile receiver rotation and foot/gripper arm operations are mutually exclusive options dictated by loading head position.

To automatically accommodate such mutually exclusive options, the undersurface of cover 180 is provided with a pair of descended, transversely elongated cam surfaces 182 flanking a mid-length (center) position of the travelling beam 42, which is always above the center aisle 25 (FIG. 3). The approaches of these horizontal cam surfaces to this mid-length position are terminated in ascending ramp surfaces 183. Thus, while loading head 70 is in the center aisle, plunger 140 is located between ramp surfaces 183, and thus plunger spring 164 is free to bias this plunger to its elevated vertical position. Also, while the loading head is in the center aisle, rotation lock plunger 166 is located within a centered notch 184 in a second cam surface 185 extending the full length of travelling beam 42. As a result, plunger 166 is elevated by its compression spring 167 to fully enable the projectile receiver rotation option and to disable the projectile receiver foot and gripper arm actuation option.

Then, as loading head 70 enters any of the magazine rows to upload/download a cell, cam surfaces 182 and 185 are in positions to depress plungers 140 and 166, respectively. The projectile receive rotation option is then automatically disabled, and the foot and gripper arms of the projectile receiver can then be actuated.

Returning to FIG. 8, projectile receiver 104 comprises a vertically elongated support 200 depending from the rotatable plate 132 of the differential gear mechanism 102. An upper hinge block 202 is affixed to the low end of support 200 and, in turn, carries a lower hinge block 204 via a pair of rods 206, as best seen in the lower end enlargement of the projectile receiver shown in FIG. 11. The upper and lower hinge blocks each includes a pair of arcuately diverging arms 208 for mounting at their vertically aligned ends hinge pins (not shown) on which the pair of gripper arms 108 may swing between closed positions, gripping an upright projectile 22 resting base down on foot 92, and open positions laterally spaced from the projectile. Frontal surfaces of the support 200 and upper and lower hinge blocks 202 and 204 are of corresponding concave shapes conforming to the projectile peripheral surface, so as to provide a further measure of lateral restraint on the projectile while gripped by the gripper arms.

Figure 11:
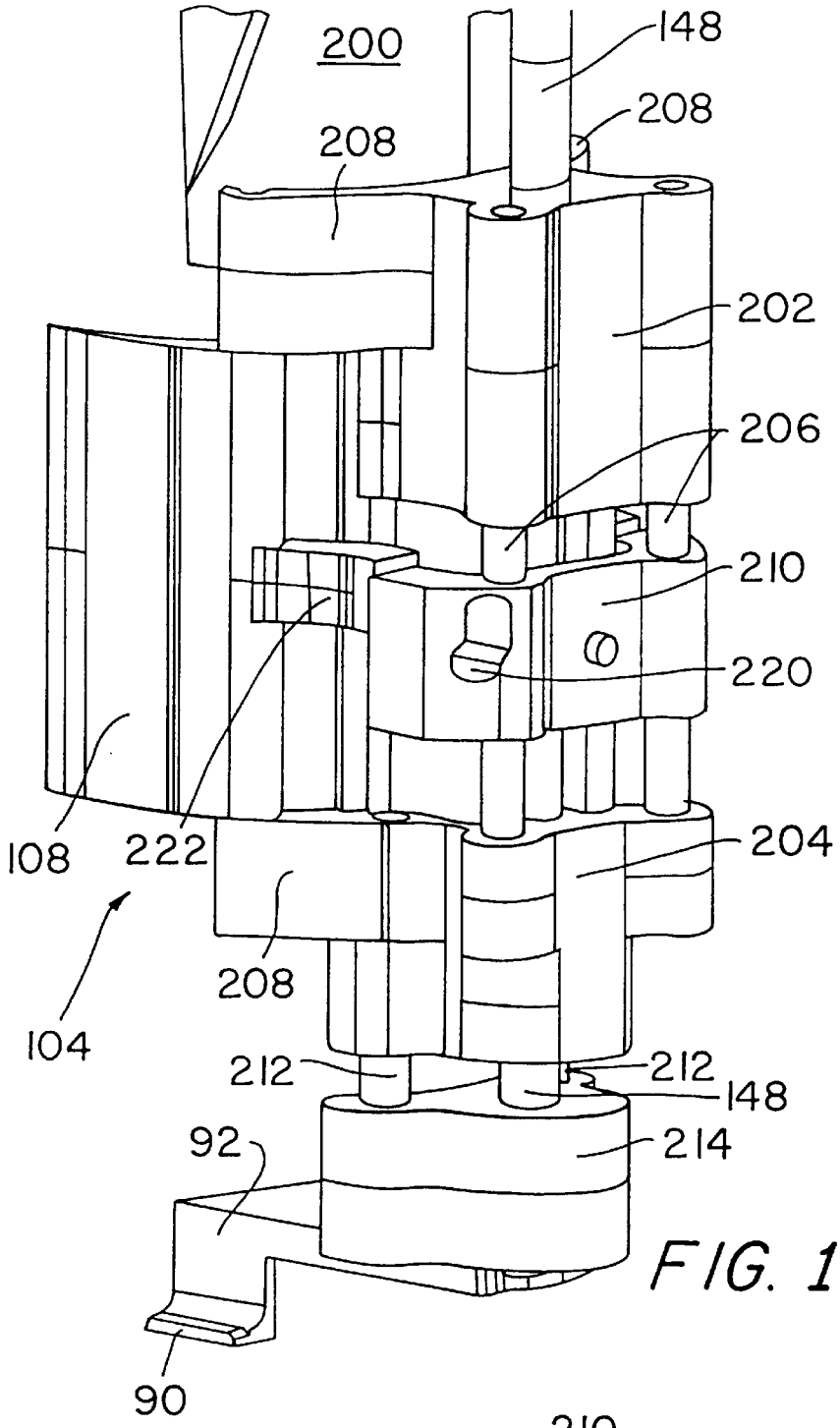
FIG. 11 is an enlarged perspective view of a projectile receiver included with the loading head of FIG. 8.

As best seen in FIG. 11, an upper slide block 210 includes vertical bores that slidingly receive rods 206 in the space between the upper 202 and lower 204 hinge blocks. Lower hinge block 204 carries a pair of depending rods 212, which are slidingly received in vertical bores formed in a lower slide block 214 that carries foot 92. Vertical lead screw 148, driven by differential gear mechanism 102, as described above with reference to FIG. 9, extends downwardly through journalling bores in the fixed vertically positioned upper and lower hinge blocks and through threaded bores machined in the upper 210 and lower 214 slide blocks. Consequently, upon driven, bidirectional rotation of lead screw 148, the upper and lower slide blocks may be raised and lowered in unison. Raising lower slide block 214 lifts foot 92 to pick up a projectile 22 at its base from its channel seat 84 (FIG. 7) in a magazine cell and continues to support the projectile in an elevated position on the projectile receiver 104 during downloading by loading head 70. Lowering slide block 214, in turn, lowers foot 92, so as to drop off a projectile onto a channel seat of a magazine cell during uploading. As described in the cited copending application, toe 90, extending laterally from foot 92 to engage in an operator tongue slot 88 (FIG. 7), is raised and lowered correspondingly to coordinate swinging motions of a cell locking members between wedge-lock and release positions in coordination with projectile lift-off and drop-off by foot 92.

Figure 12:
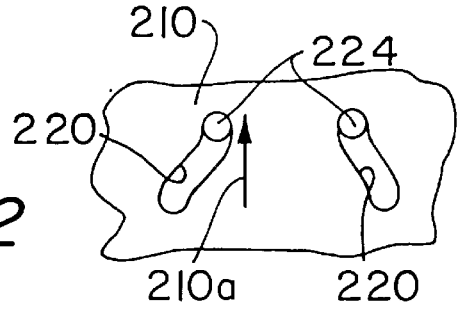
FIG. 12 is a fragmentary layout view of a portion of the projectile receiver of FIG. 11.

While lower slide block 214 is being raised and lowered by lead screw 148, so too is upper slide block 210 to achieve coordinated gripping and ungripping motions of gripper arms 108. To this end, upper slide block 210 is machined to provide a pair of cam slots 220 (one seen in FIG. 11 and the pair illustrated in simplified form in FIG. 12). Gripper arms 108 include arcuate, inwardly extending projections 222 carrying cam follower pins 224 at their inner ends, as seen in FIG. 7. As illustrated in FIG. 12, the cam follower pins 224 are respectively engaged in cam slots 220 in the upper slide block 210. These cam slots are formed to be upwardly, laterally convergent, such that when the upper slide block 210 is driven upwardly (indicated by arrow 210*a*) in concert with lower slide block 214 by lead screw 148, cam follower pins 224 move downwardly in the cam slots, and thus, are cammed further apart to force gripper arms 108 into gripping engagement with a projectile. Then, when upper slide block 210 is driven downward, cam pins 224 move upwardly in cam slots 220 to swing gripper arms 108 apart to release the projectile.

Figure 13:
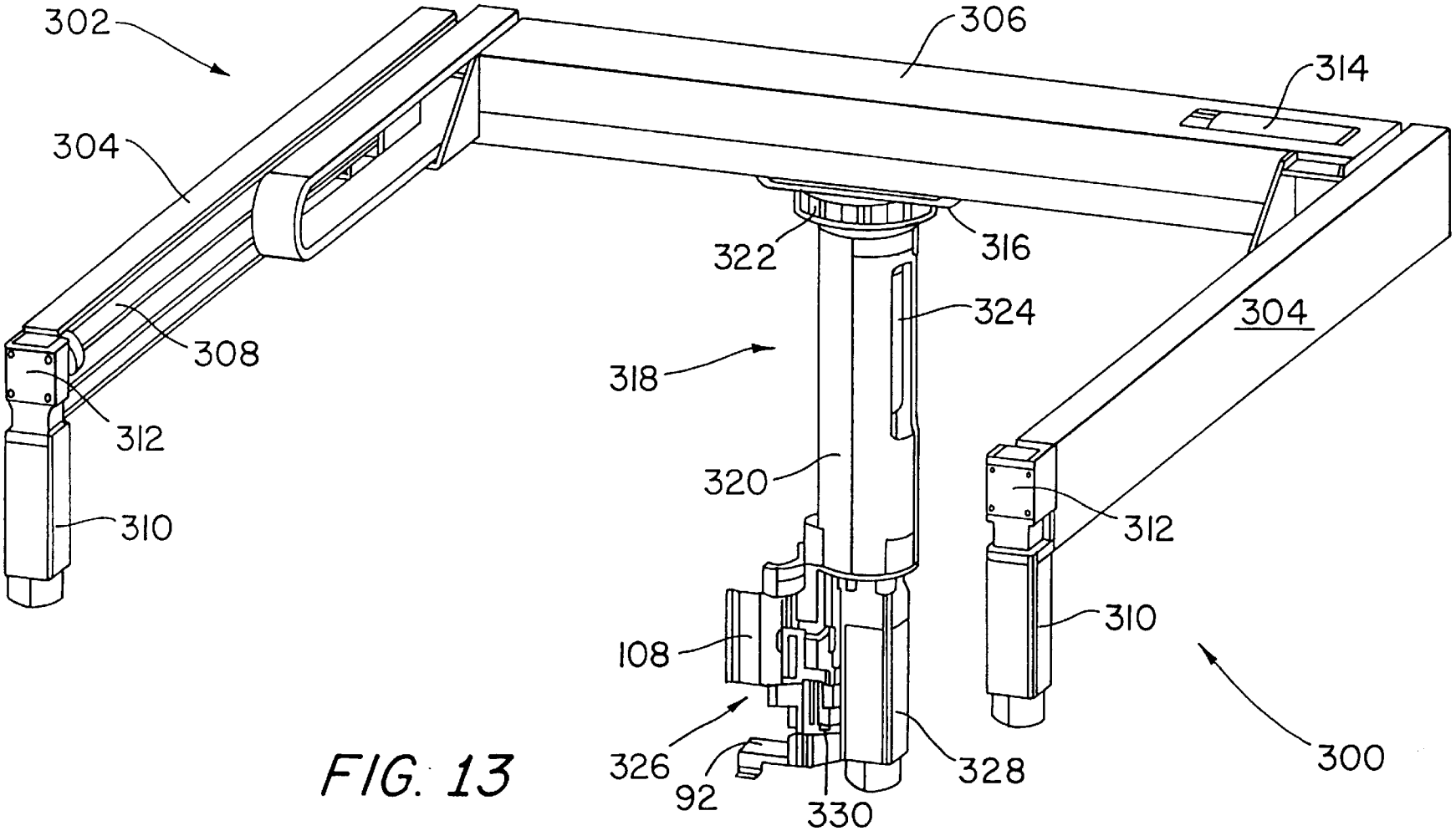
FIG. 13 is a perspective view of an ammunition storage and retrieval system of the invention, which utilizes alternative traverse mechanism and loading head features for the retrieval portion of the system.

FIG. 13 illustrates a robotic transfer mechanism, generally indicated at 300, structured in accordance with an alternative embodiment of the invention. As in the embodiment described above, transfer mechanism 300 includes an x-y traverse mechanism, generally indicated at 302, which includes a pair of elevated rails 304 mounting the ends of a travelling team 306 for longitudinal movement, essentially in the manner described above for travelling beam 42. Rails 304 include co-extensive ballscrews, one seen at 308, that are driven in synchronism by electric motors 310 via right angle bevel gear sets included in gearboxes 312 mounted at the front ends of the rails. Ballnuts (not shown) mounted at the beam ends run on the rail ballscrews 308 to produce bidirection longitudinal traverse of the travelling beam 306. Mounted at one end of the travelling beam is an electric motor 314 that drives a ballscrew (not shown), which, in turn, drives a ballnut fixed to a carriage 316 of a loading head 318. This carriage may be mounted to beam 306 in the manner of carriage 72 described above, such that the loading head can be bidirectionally driven in the traverse direction along the beam length by controlled energizations of motor 314.

Loading head 318, suspended by its carriage 316, further includes a housing 320 joined to the carriage by a gear mechanism 322. An electric motor 324 within housing 320 is controllably energized to rotate loading head 318 via gear mechanism 322 into position facing a row of cells in either the left or right cell bank. Dependent from the lower end of housing 320 is a projectile receiver 326, which may be structured in essentially the same manner as projectile receiver 104 described above. In addition, suspended from housing 320 is another electric motor 328, which is drivingly connected to a vertical lead screw 330 via a gear mechanism (now shown) mounted in the lower end of housing 320. Controlled energization of this motor raises and lowers foot 92 in coordination with opening and closing gripper arms 108 in the manner described above. To bring power into motors 314, 324, and 328 from one of the rails 304, an electrical umbilical 332 is utilized in this embodiment of the invention. An additional electrical umbilical (not shown) is incorporated in traveling beam 306 to accommodate the transverse movement of motors 324 and 328 included with loading head 318. It will be noted that while the robotic transfer mechanism 300 of FIG. 13 eliminates the need for spline shafts and associated bevel gearsets, as in robotic transfer mechanism 38 of FIGS. 3–10, it does require an additional electric motor to achieve all of the requisite motions.

It will be apparent to those skilled in the art that various modifications and variations may be made to the ammunition storage and retrieval system of the present invention without departing from the spirit of the invention. Thus, it is intended that the scope of the present invention cover modifications and variations thereof, provided they come within the spirit of the appended claims and thus equivalents.

What is claimed is:

1. An ammunition storage and retrieval system comprising:

a magazine including a plurality of rows of cells, each row including plural cells, and each cell for storing a projectile in base-down vertical orientation;

a traverse mechanism including:

a pair of elongated rails mounted in parallel, spaced relation above the magazine, and an elongated beam mounted at opposed ends by the rails for movement in first opposite directions;

a projectile loading head mounted by the beam for movement in second opposite directions along the beam, the loading head rotatably mounting a projectile receiver in suspended relation, the projectile receiver including projectile gripping arms; and motors coupled to introduce input drive through the rails and the beam, to propel the beam in the first opposite directions to position the loading head into alignment with a selected one of the cell rows and to propel the loading head in the second opposite directions along the selected row and into and out of a projectile downloading position relative to a selected one of the cells in the selected row and coupled to introduce input drive to the loading head, to rotate the projectile receiver about a vertical axis and to articulate the gripper arms between projectile gripping and releasing positions.

2. The system defined in claim 1, wherein the projectile receiver further includes a foot mounted for vertical movement, the foot engaging a projectile base and propelled in coordination with articulation of the gripper arms by one of the motors to lift the projectile from an elevated base support included in the selected cell.

3. The system defined in claim 2, wherein the projectile receiver further includes:

at least one hinge block mounting the gripper arms for swinging motions between the projectile gripping and releasing positions;

at least one slide block mounted by the hinge block for vertical motion relative to the hinge block, the slide block mounting the foot and coupled for vertical motion propulsion by the one motor; and a cam-cam follower arrangement for converting the vertical motion propulsion of the slide block into coordinated swinging motion propulsion of the gripper arms.

4. The system defined in claim 2, wherein the projectile receiver further includes:

upper and lower hinge blocks mounted in fixed, vertically spaced relation and mounting the gripper arms for swinging motions between the projectile gripping and releasing positions;

a first pair of laterally spaced guide rods mounted at upper and lower ends by the upper and lower hinge blocks, respectively;

upper and lower slide blocks, the upper slide block mounted by the first pair of guide rods for vertical motion, and the lower slide block mounting the foot;

a second pair of guide rods dependent from the lower hinge block and mounting the lower slide block for vertical motion;

a vertical lead screw extending through the upper and lower hinge blocks and threadedly engaging the upper and lower slide blocks, the one motor coupled to drive the lead screw, thereby producing coordinated vertical motions of the first and second slide blocks; and a cam-cam follower arrangement for converting vertical motion of one of the first and second slide blocks into coordinated swinging motion of the gripper arms.

5. The system defined in claim 4, wherein the cam-cam follower arrangement includes a pair of cam followers respectively carried by the gripper arms, and a pair of cam slots in the upper slide block respectively engaging the cam followers, such that propelled vertical motion of the upper slide block produces propelled swinging motion of the gripper arms between the gripping and releasing positions.

6. The system defined in claim 2, wherein the one motor is a first motor, and the system further includes:

a pair of second motors respectively mounted by the pair of rails; and the traverse mechanism further includes a pair of first elongated ballscrews respectively mounted by the pair of rails and respectively driven in unison by the second motors, and a pair of first ballnuts respectively fixed to the opposite ends of the beam and respectively engaging the first elongated ballscrews for propulsion of the beam in the first opposite directions.

7. The system defined in claim 6, wherein the first motor is carried by the loading head, the system further including a third motor carried by the beam and coupled to drive a second elongated ballscrew also carried by the beam, the separate ballscrew threadedly engaging a second ballnut fixed to the loading head for propulsion of the loading head in the second opposite directions.

8. The system defined in claim 7, further including a fourth motor carried with the first motor by the loading head and coupled to rotate the projectile receiver.

9. The system defined in claim 6, wherein the first motor is mounted by one of the rails to drive a first elongated spline shaft also mounted by the one rail, the system further including:

a second elongated spline shaft mounted by the beam; and a first right angle drive for rotationally coupling the first spline shaft to the second spline shaft;

a carriage supporting the loading head on the beam for movement in the second opposite directions;

a gear mechanism carried by the carriage and having an output drive coupled to the projectile receiver; and a second right angle drive carried by the beam for rotationally coupling the second spline shaft to an input drive of the gear mechanism.

10. The system defined in claim 9, further comprising a third motor mounted by another of the rails, the traverse mechanism further including:

a third spline shaft mounted by the other rail and driven by the third motor;

a second elongated ballscrew mounted by the beam;

a third right angle drive rotationally coupling the third spline shaft to the second ballscrew; and a second ballnut fixed to the carriage and threadedly engaging the second ballscrew, thereby coupling the third motor to propel the loading head in the second opposite directions.

11. The system defined in claim 10, wherein the magazine includes left and right banks of the rows of the cells separated by a center aisle, and wherein the gear mechanism is shiftable to produce a first output drive for rotating the projectile receiver while the loading head is located in the center aisle and to produce a second output drive for articulating the gripper arms and vertically moving the foot in coordination while the loading head is located in any one of the cell rows.

12. The system defined in claim 11, wherein the beam includes gear shifting cam surfaces at positions to engage a gear shift element of the gear mechanism depending upon whether the loading head is located in the center aisle or in any one of the cell rows, thereby shifting the gear mechanism to produce the first and second output drives, respectively.

13. The system defined in claim 12, wherein the gear mechanism further includes:

a cage carrying a ring gear driven by the input drive and circumferentially spaced bevel gears;

first and second bevel ring gears engaging the bevel gears;

a projectile receiver support plate fixed to the second bevel ring gear;

a pinion gear driven by the first bevel ring gear;

a spur gear driven by the pinion gear to produce the second output drive;

a clutch;

the gear shift element acted upon by the cam surfaces to engage and disengage the clutch, whereby to couple and decouple the first and second bevel ring gears; and an anti-rotation element acted upon by the cam surfaces to inhibit rotation of the support plate, while the clutch is disengaged, whereby to produce the second output drive, and to permit rotation of the support plate while the clutch is engaged, whereby to produce the first output drive.

14. The system defined in claim 2, wherein each cell includes:

a locking member mounted for movement between a first position engaging a projectile stored in the cell and a second position disengaging the projectile;

an actuating member; and a linkage connecting the actuating member to the locking member; and wherein the foot of the projectile receiver includes a toe for engagement with the actuating member to produce movements of the locking member between the first and second positions in response to vertical movements of the foot.

15. The system defined in claim 14 wherein the magazine includes:

a plurality of elongated superstructures fixed in spaced positions to define a plurality of the cell rows between adjacent pairs of the superstructures, each of the superstructures including:

a plurality of uniformly spaced vertical posts, adjacent pairs of the posts mounting therebetween the locking member for each cell of the cell row for movement between the first and second positions; and cross members interconnecting the adjacent pairs of posts to provide backings for the locking members of the cells in an adjacent cell row while in the first positions.

16. The system defined in claim 15, wherein the row-defining adjacent pairs of superstructures include seats serving as the base supports for projectiles residing in the rows of cells.

17. The system defined in claim 16, wherein the foot of the projectile receiver includes a toe for engagement with any one of the actuating members to produce movements of the locking member linked thereto between the first and second positions in response to vertical movements of the foot.

18. The system defined in claim 17, wherein the projectile receiver further includes:

upper and lower hinge blocks mounted in fixed, vertically spaced relation and mounting the gripper arms for swinging motions between the projectile gripping and releasing positions;

a first pair of laterally spaced guide rods mounted at upper and lower ends by the upper and lower hinge blocks, respectively;

upper and lower slide blocks, the upper slide block mounted by the first pair of guide rods for vertical motion, and the lower slide block mounting the foot;

a second pair of guide rods dependent from the lower hinge block and mounting the lower slide block for vertical motion;

a vertical lead screw extending through the upper and lower hinge blocks and threadedly engaging the upper and lower slide blocks, the one motor coupled to drive the lead screw, thereby producing coordinated vertical motions of the first and second slide blocks; and a cam-cam follower arrangement for converting vertical motion of one of the first and second slide blocks into coordinated swinging motion of the gripper arms.

19. The system defined in claim 18, wherein the cam-cam follower arrangement includes a pair of cam followers respectively carried by the gripper arms, and a pair of cam slots in the upper slide block respectively engaging the cam followers, such that propelled vertical motion of the upper slide block produces propelled swinging motion of the gripper arms between the gripping and releasing positions.

20. The system defined in claim 19, wherein the one motor is a first motor, and the system further includes:

a pair of second motors respectively mounted by the pair of rails; and the traverse mechanism further includes a pair of first elongated ballscrews respectively mounted by the pair of rails and respectively driven in unison by the second motors, and a pair of first ballnuts respectively fixed to the opposite ends of the beam and respectively engaging the first elongated ballscrews for propulsion of the beam in the first opposite directions.

21. The system defined in claim 20, wherein the first motor is carried by the loading head, the system further including a third motor carried by the beam and coupled to drive a second elongated ballscrew also carried by the beam, the second ballscrew threadedly engaging a second ballnut fixed to the loading head for propulsion of the loading head in the second opposite directions.

22. The system defined in claim 21, further including a fourth motor carried with the first motor by the loading head and coupled to rotate the projectile receiver.

23. The system defined in claim 20, further comprising a third motor mounted by one of the rails, the traverse mechanism further including:

a carriage supporting the loading head on the beam;

a first spline shaft mounted by the one rail and driven by the third motor; a second elongated ballscrew mounted by the beam; a right angle drive rotationally coupling the first spline shaft to the second ballscrew; and a second ballnut fixed to the carriage and threadedly engaging the second ballscrew, thereby coupling the third motor to propel the loading head in the second opposite directions.

24. The system defined in claim 23, wherein the first motor is mounted by one of the rails to drive a first elongated spline shaft also mounted by the one rail, the system further including:

a second elongated spline shaft mounted by the beam; and a first right angle drive for rotationally coupling the first spline shaft to the second spline shaft;

said carriage supporting the loading head on the beam being disposed to move in the second opposite directions;

a gear mechanism carried by the carriage and having an output drive coupled to the projectile receiver; and a second right angle drive carried by the beam for rotationally coupling the second spline shaft to an input drive of the gear mechanism.

25. The system defined in claim 24, wherein the magazine includes left and right banks of the rows of the cells defined by adjacent pairs of the superstructures, the left and right banks separated by a center aisle, and wherein the gear mechanism is shiftable to produce a first output drive for rotating the projectile receiver while the loading head is located in the center aisle and to produce a second output drive for articulating the gripper arms and vertically moving the foot in coordination while the loading head is located in any one of the cell rows.

26. An ammunition storage and retrieval system comprising:

a magazine including:

a plurality of elongated superstructures fixed in spaced relation to define a plurality of rows between adjacent pairs of superstructures, each row including a series of the cells and each cell accommodating a projectile in base-down vertical orientation, and each superstructure including a plurality of uniformly spaced vertical posts, a locking member mounted between each adjacent pair of the posts for pivotal motion between an elevated first position engaging a projectile in the cell of one row defined by each adjacent pair of posts and a lowered second position disengaging the projectile, a separate operator linked to pivot each locking member between the first and second positions, and cross members interconnecting the adjacent pairs of posts to provide backings for the looking members of the cells in a row the adjacent to the one row when the looking members of the cells in the adjacent row assume their first positions;

a traverse mechanism; and a loading head mounted by the traverse mechanism for first bidirectional movements into a position aligned with a selected one of the rows and second bidirectional movements along the selected row to a selected one of the cells, the loading head including a dependent projectile receiver having a pair of pivotally mounted, projectile gripping arms and a vertically movable foot for engaging a projectile base to lift the projectile, the gripping arms and the foot drivingly interconnected for coordinated movements, and the foot having a toe engageable with the operator for the selected cell to pivot the locking member therefor between the first and second positions in response to vertical motion of the foot.

27. The system defined in claim 26, further including motors coupled to introduce input drive to the traverse mechanism, to propel the loading head into alignment with the selected row and into a projectile downloading position relative to the selected cell and coupled to introduce input drive to the loading head, to rotate the projectile receiver about a vertical axis and to pivot the gripper arms between projectile gripping and releasing positions in coordination with vertical movements of the foot.

28. The system defined in claim 27, wherein the projectile receiver further includes:

at least one hinge block mounting the gripper arms for swinging motions between the projectile gripping and releasing positions;

at least one slide block mounted by the hinge block for vertical motion relative to the hinge block, the slide block mounting the foot and coupled for vertical motion propulsion by the one of the motors; and a cam-cam follower arrangement for converting the vertical motion propulsion of the slide block into coordinated swinging motion propulsion of the gripper arms.

29. The system defined in claim 28, wherein the cam-cam follower arrangement includes a pair of cam followers respectively carried by the gripper arms, and a pair of cam slots in the slide block respectively engaging the cam followers, such that propelled vertical motion of the slide block produces propelled pivoting motions of the gripper arms between the gripping and releasing positions.

30. The system defined in claim 27, wherein the traverse mechanism includes:

a pair of elongated rails mounted in parallel, spaced relation above the magazine, and a traveling beam mounted at opposed ends by the rails, the beam movably mounting the loading head such that the first bidirectional movements of the loading head are accommodated by the rails and the second bidirectional movements of the loading head are accommodated by the beam.

31. The system defined in claim 30, wherein the motors include:

a pair of first motors respectively mounted by the pair of rails; and the traverse mechanism further includes a pair of first elongated ballscrews respectively mounted by the pair of rails and respectively driven in unison by the first motors, and a pair of first ballnuts respectively fixed to the opposite ends of the beam and respectively engaging the first elongated ballscrews for propulsion of the beam in first opposite directions.

32. The system defined in claim 31, wherein the motors include a drive motor mounted by one of the rails, and the system further includes: a first elongated spline shaft mounted by the one rail and driven by the drive motor;

a second elongated spline shaft mounted by the beam; and a first right angle drive for rotationally coupling the first spline shaft to the second spline shaft;

a carriage supporting the loading head on the beam for movement in second opposite directions;

a gear mechanism carried by the carriage and having an output drive coupled to the projectile receiver; and a second right angle drive carried by the beam for rotationally coupling the second spline shaft to an input drive of the gear mechanism.

33. The system defined in claim 32, wherein the motors further include a second motor mounted by another of the rails, the traverse mechanism further including:

a third spline shaft mounted by the other rail and driven by the second motor;

a second elongated ballscrew mounted by the beam;

a third right angle drive rotationally coupling the third spline shaft to the second ballscrew; and a second ballnut fixed to the carriage and threadedly engaging the second ballscrew, thereby coupling the second motor to propel the loading head in the second opposite directions.

34. The system defined in claim 33, wherein the magazine includes left and right banks of the rows of the cells defined by adjacent pairs of the superstructures, the left and right banks separated by a center aisle, and wherein the gear mechanism is shiftable to produce a first output drive for rotating the projectile receiver while the loading head is located in the center aisle and to produce a second output drive for articulating the gripper arms and vertically moving the foot in coordination while the loading head is located in any one of the cell rows.

35. The system defined in claim 34, wherein the beam includes gear shifting cam surfaces at positions to engage a gear shift element of the gear mechanism depending upon whether the loading head is located in the center aisle or in any one of the cell rows, thereby shifting the gear mechanism to produce the first and second output drives, respectively.

* * * * *